US006749642B1

(12) United States Patent
Ueda et al.

(10) Patent No.: US 6,749,642 B1
(45) Date of Patent: Jun. 15, 2004

(54) REGENERATED COLLAGEN FIBER REDUCED IN ODOR AND IMPROVED IN SUITABILITY FOR SETTING, PROCESS FOR PRODUCING THE SAME, AND METHOD OF SETTING

(75) Inventors: Masahiro Ueda, Himeji (JP); Yoshihiro Makihara, Takasago (JP); Takashi Ueda, Amagasaki (JP); Kunihiko Matsumura, Kobe (JP)

(73) Assignees: Kaneka Corporation, Osaka (JP); Hokuyo Co., Ltd., Yamagata (JP)

( * ) Notice: Subject to any disclaimer, the term of this patent is extended or adjusted under 35 U.S.C. 154(b) by 193 days.

(21) Appl. No.: 10/018,905

(22) PCT Filed: Jun. 23, 2000

(86) PCT No.: PCT/JP00/04126

§ 371 (c)(1),
(2), (4) Date: Dec. 17, 2001

(87) PCT Pub. No.: WO01/00920

PCT Pub. Date: Jan. 4, 2001

(30) Foreign Application Priority Data

Jun. 25, 1999 (JP) ..... 11-179328
Jul. 6, 1999 (JP) ..... 11-191859

(51) Int. Cl.[7] ..... D06M 13/11; D06M 11/45
(52) U.S. Cl. ..... 8/127.5; 530/357; 530/402; 530/406
(58) Field of Search ..... 8/127.5; 530/357, 530/402, 406

(56) References Cited

U.S. PATENT DOCUMENTS 6,242,573 B1 * 6/2001 Goto et al.

FOREIGN PATENT DOCUMENTS

| | | | |
|---|---|---|---|
| EP | 999297 | * | 5/2000 |
| GB | 0 238 051 A | | 5/1991 |
| JP | 47-24199 | * | 7/1972 |
| JP | 4-50370 A | * | 2/1992 |
| JP | 4-333660 A | * | 11/1992 |
| JP | 4-352804 A | * | 12/1992 |
| JP | 5-171510 A | * | 7/1993 |

* cited by examiner

*Primary Examiner*—Margaret Einsmann
(74) *Attorney, Agent, or Firm*—Brinks Hofer Gilson & Lione

(57) ABSTRACT

The present invention provides regenerated collagen fibers which have light color and excellent touch in wet conditions and which can be formed into desirable shape with the shape being maintained properly. The present invention also provides regenerated collagen fibers whose foul odor generated in thermal treatment can be inhibited.

The present invention relates to regenerated collagen fibers obtained by treating collagen with a monofunctional epoxy compound and an aluminum salt.

The present invention also relates to a process for preparing regenerated collagen fibers which comprises treating collagen with a monofunctional epoxy compound, and then treating the same in such a way that 2 to 40% by weight of an aluminum salt converted to an aluminum oxide ($Al_2O_3$) basis is contained to said collagen.

8 Claims, 2 Drawing Sheets

REGENERATED COLLAGEN FIBER REDUCED IN ODOR AND IMPROVED IN SUITABILITY FOR SETTING, PROCESS FOR PRODUCING THE SAME, AND METHOD OF SETTING

TECHNICAL FIELD

The present invention relates to regenerated collagen fibers improved in suitability for setting. More specifically, the present invention relates to regenerated collagen fibers which have light color and excellent touch in wet conditions, which can be formed into a desirable shape easily with the shape being maintained properly and whose foul odor generated in thermal treatment is inhibited. The present invention also relates to a process for preparing the same. Such regenerated collagen fibers can be suitably used for curling hair ornaments such as wigs, hairpieces and doll hair or for shaping (setting) textile goods comprising woven fabrics or non-woven fabrics.

BACKGROUND ART

In order to produce regenerated collagen fibers, a process is adopted in general which comprises treating skin or bone of animals as a raw material with alkali or enzyme, decomposing and removing telopeptide in collagen to make it water-soluble, and spinning the same. Herein, the obtained regenerated collagen fibers are also soluble in water. In addition, when the regenerated collagen fibers contain water, shrinking starts at about 30° to 40° C., meaning that water resistance thereof is extremely inferior.

To make regenerated collagen fibers water-resistant with maintaining its light color, there are processes for treating collagen fibers with metallic salt such as aluminum salt or zirconium salt as disclosed in Japanese Unexamined Patent Publication No. 50370/1992, Japanese Unexamined Patent Publication No. 173161/1994 and Japanese Unexamined Patent Publication No. 308221/1992, and a process for treating collagen fibers with an epoxy compound as disclosed in Japanese Unexamined Patent Publication No. 352804/1992. As a process for shaping regenerated collagen fibers, a process disclosed in Japanese Unexamined Patent Publication No. 333660/1992 or Japanese Unexamined Patent Publication No. 250081/1997 which comprises moisturizing fibers in warm water or an aqueous solution containing monovalent or divalent cationic hydrosulfate, and heat-treating the fibers is known. However, when the regenerated collagen fibers which are made water-resistant by the treatment with metallic salt such as aluminum salt or zirconium salt are shaped according to the above method, shape keeping ability (set property) thereof is extremely low though certain shape can be given to the fibers. Furthermore, the given shape is lost immediately when water washing (including shampoo washing) and drying are repeated. Thus, it was difficult to use these fibers for hair products such as wigs, hairpieces and doll hair.

Though light color fibers are also obtained by using formaldehyde, the obtained fibers were not satisfactory in shaping property either. Additionally, in case of using a multivalent alcohol, i.e., glycidyl ether which is regarded as the most preferable compound among epoxy compounds described in Japanese Unexamined Patent Publication No. 352804/1992, fibers became brittle and hard, and strength thereof was remarkably lost, causing problems during production process of hair ornament, for example, hair implant or sewing machine operation. Furthermore, the fibers were not satisfactory in shaping property either.

An object of the present invention is to provide regenerated collagen fibers which have light color and excellent touch in wet conditions, which can be formed into a desirable shape easily and whose setting can be carried out with maintaining the shape properly.

DISCLOSURE OF INVENTION

In view of the current conditions mentioned above, the present invention has been completed based on the findings that it is possible to obtain regenerated collagen fibers which have natural light color of collagen, improved hardness when the fibers are wet, and excellent touch in wet conditions by combining two kinds of treatment, namely, treatment by a monofunctional epoxy compound and treatment by an aluminum salt.

The present invention relates to regenerated collagen fibers which are obtained by treating collagen with a monofunctional epoxy compound and an aluminum salt.

The present invention also relates to a process for preparing regenerated collagen fibers which comprises treating collagen with a monofunctional epoxy compound and then treating the same in such a way that 2 to 40% by weight of an aluminum salt converted to an aluminum oxide ($Al_2O_3$) basis is contained to said collagen.

The present invention also relates to a process for setting regenerated collagen fibers which comprises thermally setting the regenerated collagen fibers by means of hot water treatment at 20° to 100° C. and heat drying treatment at 60° to 220° C.

BEST MODE FOR CARRYING OUT THE INVENTION

Figure 1:
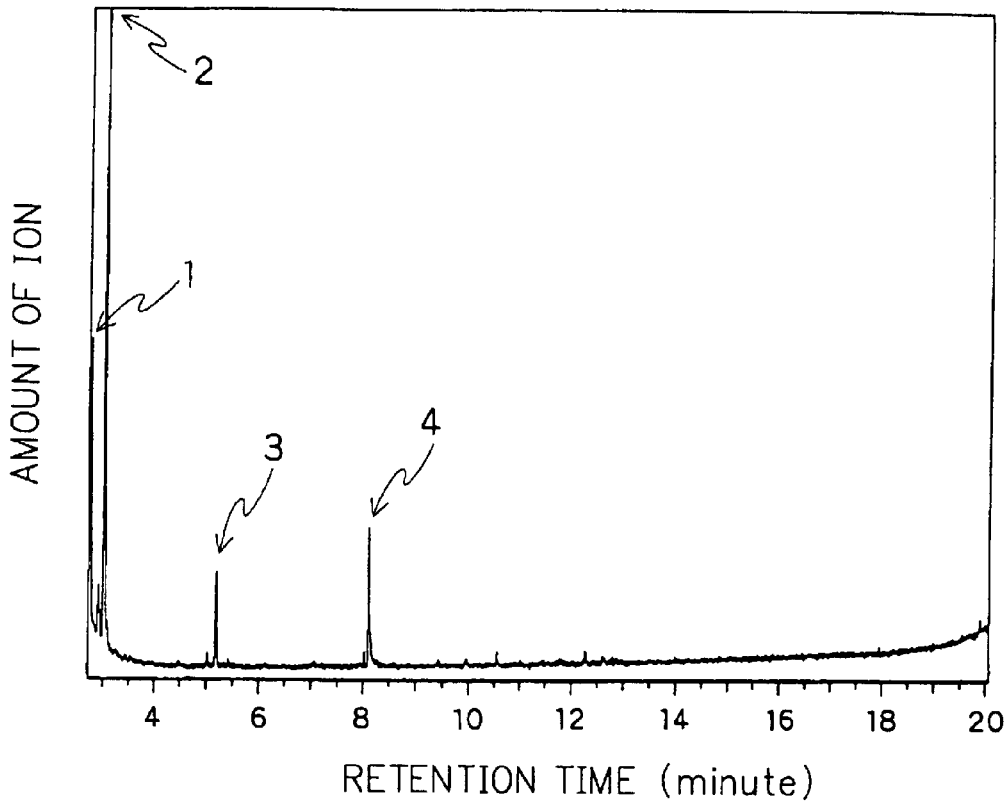
FIG. 1 is a chart obtained by measurement of gas generated from regenerated collagen fibers prepared in Example 6 by using a gas chromatograph mass spectrometer.

The regenerated collagen fibers of the present invention are obtained by treating collagen with a monofunctional epoxy compound and an aluminum salt. It is preferable that the regenerated collagen fibers of the present invention are obtained by treatment with a monofunctional epoxy compound and an aluminum salt after oxidizing methionine groups. Alternatively, part or all of the methionine groups in the collagen fibers may be present in the form of sulfoxidized methionine group or sulfonated methionine group.

It is preferable to use split hide as a raw material of collagen in the present invention. Such split hide is obtained from fresh split hide or salted rawhide of slaughtered animals such as cows. Split hide comprises insoluble collagen fibers for the most part and used after cleaning reticulated flesh or removing salt added to prevent decay and deterioration.

The insoluble collagen fibers contain impurities such as lipid including glyceride, phospholipid or free fatty acid, and protein other than collagen such as glycoprotein or albumin. These impurities have great influence on spinning stability in forming fiber, qualities such as gloss, strength and elongation, and smell in the process of fiber spinning. Therefore, it is preferable to remove the above impurities previously by carrying out conventional leather treatment such as acid or alkali treatment, enzyme treatment or solvent treatment after disassembling collagen fibers by soaking the collagen fibers, for example, in lime to hydrolyze lipid in the insoluble collagen fibers.

The thus-treated insoluble collagen fibers are then subjected to solubilization treatment in order to cut the crosslinked peptides. As the process for solubilization treatment, generally known alkali solubilization processes or enzyme solubilization processes can be adopted.

In case of applying the alkali solubilization process, neutralization is preferably carried out by acid such as hydrochloric acid. Alternatively, a process disclosed in Japanese Examined Patent Publication No. 15033/1971 may be used as an improved method of conventionally known alkali solubilization processes.

The above enzyme solubilization process has an advantage that regenerated collagen having uniform molecular weight can be obtained, and can be suitably used for the present invention. As the enzyme solubilization process, it is possible to adopt processes described in Japanese Examined Patent Publication No. 25829/1968 and Japanese Examined Patent Publication No. 27513/1968. Furthermore, both of the above alkali solubilization process and the enzyme solubilization process may be employed together.

Collagen treated with the above solubilization process is preferably subjected to further treatment such as pHadjustment, salting out, water washing or solvent treatment, since regenerated collagen having excellent qualities can be obtained if such treatment is carried out.

The obtained solubilizable collagen is dissolved by using an acidic solution whose pH is adjusted to pH 2 to pH 4.5 with an acid such as hydrochloric acid, acetic acid or lactic acid to obtain a concentrate solution having a given concentration of, for example, about 1 to 15% by weight, preferably about 2 to 10%. If necessary, the obtained collagen aqueous solution may be subjected to defoaming with stirring under reduced pressure or filtration in order to remove water-insoluble minute contaminant. If necessary, a suitable amount of additives such as a stabilizer and a water-soluble polymer compound may be added to the solubilizable collagen solution to be obtained for the purpose of increasing mechanical strength, enhancement of water resistance and heat resistance, development of gloss, improvement of fiber spinning properties, coloring prevention, corrosion proof, and the like.

The solubilizable collagen solution is discharged, for example, from a spinning nozzle or a slit and immersed into an inorganic salt aqueous solution to prepare regenerated collagen fibers. An aqueous solution of water-soluble inorganic salts such as sodium sulfate, sodium chloride and ammonium sulfate is used as the inorganic salt aqueous solution. Usually, concentration of these inorganic salts is adjusted to 10 to 40% by weight. The pH of the inorganic salt solution is generally adjusted to pH 2 to pH 13, preferably pH 4 to pH 12 by adding, for example, a metallic salt such as sodium borate or sodium acetate, hydrochloric acid, boric acid, acetic acid, sodium hydroxide, and the like. In the case where the pH is less than 2 and the case where the pH is more than 13, there is a tendency that peptide bond in collagen is easily hydrolyzed and it becomes difficult to obtain the aimed fibers. The temperature of the inorganic salt solution is not particularly limited, but preferably at most 35° C. in general. When the temperature is higher than 35° C., solubilizable collagen tends to be denatured, or strength of fibers to be obtained is lowered, making stable fiber spinning difficult. The lowest temperature is not particularly limited and suitably adjusted in accordance with the solubility of inorganic salt.

A suitable amount of additives such as a stabilizer and a water-soluble polymer compound may be added to the solubilizable collagen solution obtained in the above manner, if necessary, for the purpose of increasing mechanical strength, enhancement of water resistance and heat resistance, development of gloss, improvement of fiber spinning properties, coloring prevention, corrosion proof, and the like.

In the present invention, the above regenerated collagen fibers are treated with a monofunctional epoxy compound or by immersion to solution thereof.

Concrete examples of the monofunctional epoxy compound are olefin oxides such as ethylene oxide, propylene oxide, butylene oxide, isobutylene oxide, octene oxide, styrene oxide, methylstyrene oxide, epichlorohydrin, epibromohydrin or glycidol, glycidyl ethers such as glycidyl methyl ether, butyl glycidyl ether, octyl glycidyl ether, nonyl glycidyl ether, undecyl glycidyl ether, tridecyl glycidyl ether, pentadecyl glycidyl ether, 2-ethylhexyl glycidyl ether, allyl glycidyl ether, phenyl glycidyl ether, cresyl glycidyl ether, t-butylphenyl glycidyl ether, dibromophenyl glycidyl ether, benzyl glycidyl ether, polyethyleneoxide glycidyl ether, glycidyl esters such as glycidyl formate, glycidyl acetate, glycidyl acrylate, glycidyl methacrylate or glycidyl benzoate, glycidyl amides and the like. However, the present invention is not limited to these examples.

Among monofunctional epoxy compounds, it is preferable to use the monofunctional epoxy compound represented by the following formula (1) to lower water adsorption of the regenerated collagen fibers:

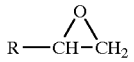

(I)

wherein R indicates a substituent group represented by $R_1$—, $R_2$—O—$CH_2$— or $R_2$—COO—$CH_2$—, $R_1$ in the substituent group indicates a hydrocarbon group having at least 2 carbon atoms or $CH_2Cl$ and $R_2$ indicates a hydrocarbon group having at least 4 carbon atoms.

Examples of the compound represented by the above formula (1) are butylene oxide, octene oxide, styrene oxide, methylstyrene oxide, epichlorohydrin, butyl glycidyl ether, octyl glycidyl ether, nonyl glycidyl ether, undecyl glycidyl ether, tridecyl glycidyl ether, pentadecyl glycidyl ether, 2-ethylhexyl glycidyl ether, phenyl glycidyl ether, cresyl glycidyl ether, t-butylphenyl glycidyl ether, benzyl glycidyl ether, glycidyl benzoate and the like.

In particular, monofunctional epoxy compounds whose $R_1$ in the above formula is hydrocarbon group having 2 to 6 carbon atoms or $CH_2Cl$, such as butylene oxide, octene oxide, styrene oxide or epichlorohydrin, or monofunctional epoxy compounds whose $R_2$ in the above formula is hydrocarbon group having 4 to 6 carbon atoms, such as butyl glycidyl ether, phenyl glycidyl ether or glycidyl benzoate are preferably used from the viewpoints that treatment can be carried out faster due to high reactivity and that treatment in water is relatively easy.

The amount of the monofunctional epoxy compound is 0.1 to 500 equivalent, preferably 0.5 to 100 equivalent, more preferably 1 to 50 equivalent based on the amount of amino group which can react with the monofunctional epoxy compound in the regenerated collagen fibers measured according to the method of amino acid analysis. When the amount of the monofunctional epoxy compound is less than 0.1 equivalent, insolubilization effect of regenerated collagen fibers against water is insufficient. On the other hand, the amount of more than 500 equivalent is unfavorable from the viewpoint of industrial handling or from an environmental point of view though insolubilition effect is satisfactory.

The monofunctional epoxy compound is used as it is or after dissolving the same into various solvents. Examples of the solvent are water, alcohols such as methyl alcohol, ethyl alcohol or isopropanol, ethers such as tetrahydrofran and dioxane, organic halogenated organic solvents such as dichloromethane, chloroform and carbon tetrachloride, neutral organic solvents such as dimethylformamide (DMF) and dimethylsulfoxide (DMSO), and the like. A mixed solvent thereof may also be used. When water is used as the solvent, an aqueous solution of inorganic salt such as sodium sulfate, sodium chloride or ammonium sulfate may be used if necessary. Usually, the concentration of these inorganic salts is adjusted to 10 to 40% by weight. The pH of the aqueous solution may be adjusted by adding metallic salts such as sodium borate or sodium acetate, hydrochloric acid, boric acid, acetic acid and sodium hydroxide. In this case, the pH is preferably at least 6, more preferably at least 8. When the pH is less than 6, the reaction between epoxy group in the monofunctional epoxy compound and amino group in collagen slows down, making insolubilization against water insufficient. As pH tends to decrease with time, a buffer may be used if necessary.

The temperature for treating regenerated collagen fibers by using an epoxy compound is preferably at most 50° C. When the treatment temperature is higher than 50° C., regenerated collagen fibers tend to be denatured and strength of the fibers to be obtained is lowered, making stable fiber spinning difficult.

In addition, various additives such as catalysts and reaction auxiliaries may also be used. Examples of the catalyst are amines and imidazoles. Concretely, examples of the amines include tertiary amines such as triethyl diamine, tetramethyl guanidine, triethanol amine, N,N'-dimethylpiperazine, benzyldimethyl amine, dimethylaminomethyl phenol and 2,4,6-tris(dimethylaminomethyl) phenol, secondary amines such as piperazine and morpholine, quaternary ammonium salts such as tetramethyl ammonium salt, tetraethyl ammonium salt and benzyltriethyl ammonium salt, and the like. Examples of the imidazoles include 2-methylimidazol, 2-ethylimidazole, 2-isopropylimidazol, 1-cyanoethyl-2-methylimidazol, 1-cyanoethyl-2-ethylimidazole, 1-cyanoethyl-2-isopropylimidazol, 2-ethyl-4-methylimidazol, and the like. Examples of the reaction auxiliary are salicylic acid or metallic salt of salicylic acid; thiocyanic acid salts such as thiocyanic acid and ammonium thiocyanate; tetramethylthiramdisulfide; thiourea; and the like.

In the present invention, the regenerated collagen fiber is subjected to water washing if necessary. Water washing has an advantage of removing inorganic salt which was mixed to the fibers during the fiber spinning process.

The above regenerated collagen fibers are then immersed into an aluminum salt aqueous solution in the present invention. According to this treatment, hardness can be imparted to regenerated collagen fibers even in wet conditions, wet touch of fibers is improved and shaping such as curl setting becomes excellent. Alternatively, a process disclosed in Japanese Unexamined Patent Publication No. 173161/1994 may be adopted as an improved method of conventionally known aluminum salt treatment.

The treatment is carried out so that fibers after treatment contain 2 to 40% by weight, preferably 2 to 20% by weight, more preferably 5 to 20% by weight of an aluminum salt converted to an aluminum oxide ($Al_2O_3$) basis. When the amount is less than 2% by weight, wet touch of fibers becomes poor and shaping such as curl setting are weak. When the amount is more than 40% by weight, fibers after treatment are hardened, making it impossible to achieve favorable touch.

The kind of aluminum salt used herein is not particularly limited. Examples thereof are aluminum sulfate, aluminum chloride, basic aluminum chloride, basic aluminum sulfate and the like. Basic aluminum chloride and basic aluminum sulfate are represented by the following formula (II) and (III), respectively:

$$Al(OH)_nCl_{3-n} \quad (II)$$

$$Al_2(OH)_{2n}(SO_4)_{3-n} \quad (III)$$

wherein n is 0.5 to 2.5.

These aluminum salts may be used alone or in combination of two or more. The concentration of the aluminum salt in aqueous solution thereof is preferably 0.3 to 5% by weight converted to an aluminum oxide ($Al_2O_3$) basis. When the concentration is less than 0.3% by weight, regenerated collagen fibers tend to have a small aluminum content, wet touch of fibers becomes inferior and shaping such as curl setting becomes weak. When the concentration is more than 5% by weight, fibers after treatment are hardened, making it impossible to achieve favorable touch.

The pH of the aluminum salt aqueous solution is normally adjusted to pH 2.5 to pH 6.5, preferably pH 2.5 to pH 5.5 by using, for example, hydrochloric acid, sulfuric acid, acetic acid, sodium hydroxide, sodium carbonate or the like. When the pH is less than 2.5, there is a tendency that collagen structure is destroyed and denatured. When the pH is more than 6.5, aluminum salt precipitates and is hardly immersed into fibers. The pH can be adjusted by adding, for example, sodium hydroxide or sodium carbonate to fibers. It is preferable to immerse an aluminum salt solution into regenerated collagen fibers with adjusting the pH to 2.2 to 5.0 at first, and then complete the immersion with adjusting the pH to 3.5 to 6.5. When an aluminum salt having high basicity is used, it may be sufficient to carry out only the first pH adjustment of 2.5 to 6.5. The temperature of the aluminum salt solution is not particularly limited, but preferably at most 50° C. When the temperature of the solution is higher than 50° C., regenerated collagen fibers tend to be denatured.

The time to immerse an aluminum salt aqueous solution into regenerated collagen fibers is at least 10 minutes, preferably 1 to 25 hours. When the immersion time is shorter than 10 minutes, reaction of aluminum salt is difficult to proceed and improvement of wet touch of fibers is insufficient. Though there is no particular upper limit for the immersion time, reaction of aluminum salt proceeds sufficiently and wet touch of fibers becomes excellent within 25 hours.

In order to avoid uneven concentration by rapid absorption of aluminum salt into regenerated collagen fibers, inorganic salts such as sodium chloride, sodium sulfate and potassium chloride may be suitably added to the above aluminum salt aqueous solution in a concentration of 1 to 20% by weight. In order to improve stability of aluminum salt in water, an organic salt such as sodium formate or sodium citrate may be suitably added to the above aluminum salt aqueous solution in a concentration of 0.1 to 5% by weight, preferably 0.5 to 2% by weight.

The regenerated collagen fibers treated with aluminum salt are then subjected to washing in water, oiling and drying. Washing is carried out, for example, in water for about 10 minutes to 4 hours. As the oil solution used for oiling, it is possible to use an oil solution comprising an emulsion such as silicones modified with amino group, silicones modified with epoxy group, silicones modified with polyether, and PLURONIC polyether antistatic agent. Drying is carried out at the temperature of preferably at most 100° C., more preferably at most 75° C. under gravity of 0.01 to 0.25 g, preferably 0.02 to 0.15 g per 1 dtex.

Water washing is carried out at this stage in order to prevent oil precipitation due to salt, or to prevent generation of break in regenerated collagen fibers caused by the salt precipitated from the regenerated collagen fibers during the drying step in a dryer. In addition, water washing can prevent lowering of heat transfer coefficient caused by the salt scattered and adhered to the heat exchanger in the dryer. When oiling is carried out, there are effects on prevention of sticking of fibers and improvement of surface properties thereof in dry conditions.

Meanwhile, fibers treated with a monofunctional epoxy group have problems of generating foul odor when heat is applied to the fibers during the drying process or the like, such foul odor being intensified when fibers as hair materials are exposed to higher temperature by using a dryer or hair iron. The reason of this foul odor is the sulfur-containing compound generated when the methionine group unstabilized by the reaction of the monofunctional epoxy compound with sulfur atom in the methionine group is thermally decomposed during heat treatment including drying process or the like. It is possible to inhibit this foul odor by using, in the reaction with a monofunctional epoxy group, regenerated collagen fibers whose methionine group is changed to, for example, sulfoxidized methionine group or sulfonated methionine group by oxidation.

In particular, foul odor may be intensified when a monofunctional epoxy group and a metallic salt such as an aluminum salt are used together as in the present invention since the metallic salt acts as a catalyst for the thermal decomposition. In such cases, it is very effective to use, in the reaction with a monofunctional epoxy compound, regenerated collagen fibers whose methionine group is oxidized and changed to sulfoxidized methionine group or sulfonated methionine group.

As the process for oxidizing methionine group in collagen, there is a process for treating collagen with an oxidant. The treatment with the oxidant may be carried out at any stage as long as it precedes the treatment with the monofunctional epoxy group. In case of treating a solid material such as split hide or regenerated collagen fibers after fiber spinning, the treatment may be carried out by immersing the solid material in an oxidant or solution thereof. In case of treating a solubilized collagen aqueous solution, the treatment may be carried out by adding an oxidant or solution thereof to the collagen solution and mixing the solution sufficiently.

Examples of the oxidant are peroxides such as peracetic acid, perbenzoic acid, benzoyl peroxide, perphthalic acid, m-chloro perbenzoic acid, t-butyl hydroperoxide, periodic acid, sodium periodate and hydrogen peroxide, nitrogen oxides such as nitrogen dioxide, nitric acid, dinitrogen tetroxide and pyridine-N-oxide, metal oxides such as potassium permanganate, absolute chromic acid, sodium bichromate and manganese dioxide, halogens such as chlorine, bromine and iodine, halogenating agents such as N-bromosuccinimide, N-chlorosuccinimide and sodium hypochlorite, and the like. Among these, hydrogen peroxide is preferably used since by-products do not remain in the regenerated collagen fibers and handling of hydrogen peroxide is easy.

The oxidant is used as it is or by dissolving the same into various solvents. Examples of the solvent are water, alcohols such as methyl alcohol, ethyl alcohol or isopropanol, ethers such as tetrahydrofran and dioxane, organic halogen solvents such as dichloromethane, chloroform and carbon tetrachloride, neutral organic solvents such as DMF and DMSO, and the like. A mixed solvent thereof may also be used. When water is used as the solvent, an aqueous solution of inorganic salt such as sodiumsulfate, sodium chloride or ammonium sulfate may be used if necessary. Usually, the concentration of such inorganic salt is adjusted to 10 to 40% by weight.

As to the amount of the oxidant, it is most preferable from an industrial point of view that all of the oxidant is used for the reaction. The amount of the oxidant in this case is 1.0 equivalent based on the amount of methionine group in the regenerated collagen fibers (for example, according to amino acid analysis, the number of methionine groups present in regenerated collagen fibers derived from cow skin is 6 per 1,000 amino acid groups constituting collagen). However, since some portions of the oxidant are not involved in the actual reaction, the oxidant should be used in an amount of at least 1.0 equivalent.

In case where a solid material such as split hide or regenerated collagen fibers after fiber spinning is immersed in an oxidant solution, it is necessary to use the oxidant solution in such an amount that split hide or regenerated collagen fibers are completely immersed. The amount of the oxidant in this case is at least 1.0 equivalent, preferably at least 5.0 equivalent, and more preferably at least 10.0 equivalent based on the amount of methionine group. The concentration of the oxidant in solution thereof is at least 0.01% by weight, preferably at least 0.1% by weight, more preferably at least 0.5% by weight, and most preferably at least 0.8% by weight. When the concentration of the oxidant is less than 0.01% by weight, the reaction of the oxidant with methionine group is difficult, since the number of reactive sites is small. When the amount of the oxidant is less than 1.0 equivalent, the effect of deodorizing regenerated collagen fibers is insufficient. Usually, it is preferable that the temperature for the treatment is at most 35° C. The treatment is usually carried out for at least 5 minutes and the deodorizing effect is achieved in about 10 minutes in case of treating regenerated collagen fibers. On the other hand, the reaction is carried out thoroughly in case of treating split hide into which the oxidant does not permeate easily, with keeping split hide immersed in the oxidant solution overnight.

In case of treating a solubilized collagen aqueous solution, the amount of oxidant is at least 1.0 equivalent, preferably at least 5.0 equivalent, more preferably at least 10.0 equivalent. The concentration of the oxidant in the collagen aqueous solution is at least 0.01% by weight, preferably at least 0.05% by weight, more preferably at least 0.1% by weight, and most preferably at least 0.2% by weight. When the concentration of the oxidant is less than 0.01% by weight, the reaction of oxidant with methionine group is difficult since the number of reactive sites is small. When the amount of the oxidant is less than 1.0 equivalent, the effect of deodorizing regenerated collagen fibers is insufficient. Preferably, the above treatment is carried out also at 35° C. or lower. The solubilized collagen aqueous solution after adding the oxidant is mixed sufficiently for at least 30 minutes to contact the oxidant with collagen.

The regenerated collagen fibers of the present invention can be curled as aimed, other shapes being easily imparted thereto and setting being carried out with maintaining the shape properly, by thermally setting the regenerated collagen fibers by means of hot water treatment at 20° to 100° C. and heat drying treatment at 60° to 220° C. The detailed mechanism of the above shaping is still unknown. However, it is considered that hydrogen bond in regenerated collagen fibers is cut by the hot water treatment and the subsequent heat drying treatment enables re-bonding of hydrogen so that the re-bonded structure corresponds to the aimed shape, making it possible to impart a reliable shape. The temperature of the treatment is a critical factor for the secure shaping.

The hot water treatment means a thermal treatment performed in the presence of water. The treatment may include immersing fibers in water adjusted to a pre-determined temperature, or putting, into a plastic bag, fibers once immersed in water to contain sufficient water, sealing the bag and keeping the same in an air thermostat adjusted to a pre-determined temperature.

Specifically, a preferable treatment is such that regenerated collagen fibers are fixed in a desirable shape (spiral shape and the like) with adjusting the temperature of the regenerated collagen fibers to 20° to 100° C. in the presence of water. The temperature of the fiber is measured by inserting a thermocouple into the fiber bundle.

Though it is very difficult to determine the amount of water existing on the surface of the regenerated collagen fibers in case of treating fibers in the presence of water, it is preferable to distribute water on the surface almost uniformly so that the regenerated collagen fibers are treated equally.

According to this treatment conducted in the presence of water, it becomes difficult to impart a desirable shape to regenerated collagen fibers when the temperature of the regenerated collagen fibers is too low. On the other hand, it is feared that the regenerated collagen fibers are deformed when the temperature of the regenerated collagen fibers is too high. It is desired that the treatment is carried out at temperature of usually 20° to 100° C., preferably 50° to 100° C., more preferably 70° to 100° C., and most preferably 80° to 90° C.

The time for hot water treatment is suitably determined in accordance with atmosphere and temperature adopted for treating regenerated collagen fibers. The fibers are usually treated for at least 5 minutes, preferably at least 15 minutes.

Secondly, the heat drying treatment means a treatment to put a fiber bundle into a hot air convection dryer or to carry out heating by applying hot air to the fibers using a dryer and the like, while any conventional process may be used without particular limitation. Specifically, it is preferable to carry out drying under air of 60° to 220° C. with fixing fibers in a pre-determined shape after the hot water treatment.

When the temperature is lower than 60° C., it becomes difficult to impart a desirable shape to the regenerated collagen fibers. On the other hand, when the temperature is higher than 220° C., it is feared that regenerated collagen fibers are deformed and colored. It is desired that the treatment is carried out at a temperature of usually 60° to 220° C., preferably 90° to 160° C., more preferably 100° to 130° C., and most preferably 110° to 120° C.

The time for heat drying treatment is suitably determined in accordance with temperature for drying, the amount of fibers to be dried and the like. The fibers are usually treated for at least 5 to 120 minutes, preferably at least 10 to 60 minutes, more preferably 15 to 30 minutes.

According to these treatments, regenerated collagen fibers can be set to desirable shapes with maintaining those shapes properly.

As a process for fixing regenerated collagen fibers in a desirable shape previously, there is a process to wind regenerated collagen fibers along a pipe or a bar, a process to stretch regenerated collagen fibers between two or more supporting points, a process to clip regenerated collagen fibers between plates, and the like. Another process may be employed as long as the fibers are fixed in a desirable shape while water is supplied to the fibers sufficiently and the fibers can be dried at 60° C. or more.

The regenerated collagen fibers of the present invention can be suitably used as fibers for hair and blankets, surgical thread, gut as well as fibers used for non-woven fabric, paper and the like.

Furthermore, since regenerated collagen fibers of the present invention are formed into a desirable shape easily with the shape being maintained properly in addition to the advantages of light color and excellent touch in wet conditions, such regenerated collagen fibers are suitably used for curling hair ornaments such as wigs, hairpieces and doll hair or for shaping (setting) textile goods comprising woven fabrics or non-woven fabrics.

Hereinafter, the present invention is explained in more detail based on Examples, but the present invention is not limited thereto.

EXAMPLE 1

A piece of cow split hide was subjected to solubilization treatment with alkali as a raw material, and 1,200 g of the treated skin (collagen content: 180 g) was dissolved in an aqueous solution containing lactic acid to prepare a concentrate solution adjusted to pH 3.5 and collagen concentration of 6% by weight. The concentrate solution was subjected to stirring and defoaming under reduced pressure by using a stirring defoamer (type 8DMV made by DALTON Co. Ltd.). The solution was then transferred to a piston type concentrate solution tank for fiber spinning and kept under reduced pressure to carry out further defoming. The concentrate solution was extruded, supplied in fixed quantities by using a gear pump and then filtered through a sintered filter having a pore diameter of 10 $\mu$m. The solution was discharged into a 25° C. coagulation bath containing 20% by weight of sodium sulfate (adjusted to pH 11 by boric acid and sodium hydroxide) through a spinning nozzle having a pore diameter of 0.30 mm, a pore length of 0.5 mm and a pore number of 300 at a spinning rate of 5 m/minute.

Then, the obtained regenerated collagen fibers were immersed into 16.6 kg of an aqueous solution containing 1.7% by weight of epichlorohydrin, 0.9% by weight of 2,4,6-tris(dimethylaminomethyl)phenol, 0.09% by weight of salicylic acid and 13% by weight of sodium sulfate at 25° C. for 24 hours. The amount of added epichlorohydrin was 42.6 equivalent based on the amount of amino group in collagen.

After an hour of washing by running water, the fibers were immersed in 16.6 kg of an aqueous solution containing 10% by weight of basic aluminum chloride (Bellcotan AC-P available from Nippon Fine Chemical Co., Ltd.) and 5% by weight of sodium chloride at 25° C. for 12 hours. Thereafter, the obtained fibers were washed by running water for two hours.

Then, an oiling agent containing emulsion of silicones modified with amino group and a PLURONIC polyether antistatic agent was applied to the fibers by immersing part of the fibers in a bath filled with the oiling agent. In a hot air convection dryer (PV-221 made by Tabai Espec Corporation) adjusted to 50° C., one end of a fiber bundle was fixed, and a weight of 3.6 g was attached to each fiber at the other end of the bundle. Drying was carried out for two hours in the state of tension and measurement was conducted.

EXAMPLE 2

Experiment was carried out in the same manner as in Example 1 except for changing the monofunctional epoxy compound to phenyl glycidyl ether.

EXAMPLE 3

Experiment was carried out in the same manner as in Example 1 except for changing the amount of basic aluminum chloride to 5% by weight.

EXAMPLE 4

Experiment was carried out in the same manner as in Example 2 except for changing the amount of basic aluminum chloride to 5% by weight.

EXAMPLE 5

Experiment was carried out in the same manner as in Example 1 except that the treatment with aluminum salt was carried out by immersing fibers in 16.6 kg of an aqueous solution containing 5% by weight of basic aluminum chloride, 6% by weight of sodium chloride and 1% by weight of sodium formate at 4° C. for 12 hours.

EXAMPLE 6

The regenerated collagen fibers obtained in the same manner as in Example 1 were immersed in 16.5 kg of an aqueous solution containing 1.7% by weight of epichlorohydrin, 0.09% by weight of 2,4,6-tris (dimethylaminomethyl)phenol, 0.009% by weight of salicylic acid and 13% by weight of sodium sulfate at 25° C. for 24 hours. The amount of added epichlorohydrin was 42.1 equivalent based on the amount of amino group in collagen.

After an hour of washing by running water, the fibers were immersed in 16.5 kg of an aqueous solution containing 6% by weight of basic aluminum chloride and 5% by weight of sodium chloride at 30° C. for 12 hours. Thereafter, the obtained fibers were washed by running water for two hours.

Then, an oiling agent containing emulsion of silicones modified with amino group and a PLURONIC polyether antistatic agent was applied to the fibers by immersing part of the fibers in a bath filled with the oiling agent. In a hot air convector dryer adjusted to 50° C., one end of a fiber bundle was fixed, and a weight of 3.6 g was attached to each fiber at the other end of the bundle. Drying was carried out for two hours in the state of tension and measurement was conducted.

EXAMPLE 7

Experiment was carried out in the same manner as in Example 6 except that 110 g of a hydrogen peroxide aqueous solution diluted to a concentration of 10% by weight (the amount of hydrogen peroxide is 30 equivalent based on methionine group) was added to the concentrate solution before defoaming, and then the mixture was stirred for 30 minutes by using a kneader (type PNV-5 made by Irie Shokai Co., Ltd.) and kept overnight.

EXAMPLE 8

Experiment was carried out in the same manner as in Example 7 except that the treatment with aluminum salt was carried out by immersing fibers in 16.5 kg of an aqueous solution containing 5% by weight of basic aluminum chloride, 6% by weight of sodium chloride and 1% by weight of sodium formate at 4° C. for 15 hours.

EXAMPLE 9

Experiment was carried out in the same manner as in Example 7 except for changing the monofunctional epoxy compound to phenyl glycidyl ether.

EXAMPLE 10

Experiment was carried out in the same manner as in Example 8 except for changing the time for immersion in an aqueous solution of basic aluminum chloride (prepared in the same manner as in Example 8) to 10 minutes.

EXAMPLE 11

Experiment was carried out in the same manner as in Example 7 except that the treatment with aluminum salt was carried out by immersing fibers in 16.5 kg of an aqueous solution containing 5% by weight of aluminum sulfate 13 to 14 hydrate (crystal) (available from NACALAI TESQUE, INC.), 1% by weight of trisodium citrate dihydrate and 1.3% by weight of sodium hydroxide at 30° C. for 15 hours.

EXAMPLE 12

Experiment was carried out in the same manner as in Example 11 except for changing the time for immersion in an aqueous solution of aluminum sulfate(prepared in the same manner as in Example 11) to 10 minutes.

EXAMPLE 13

Experiment was carried out in the same manner as in Example 7 except that oxidation was carried out by immersing fibers in 1,836 g of an aqueous solution containing 2.0% by weight of hydrogen peroxide (the amount of hydrogen peroxide is 100 equivalent based on methionine group) and then the mixture was kept overnight.

EXAMPLE 14

Experiment was carried out in the same manner as in Example 6 except that the obtained regenerated collagen fibers were immersed in 16.5 kg of an aqueous solution containing 1.0% by weight of hydrogen peroxide and 13% by weight of sodium sulfate at 25° C. for an hour after fiber spinning.

COMPARATIVE EXAMPLE 1

Experiment was carried out in the same manner as in Example 8 except that insolubilization treatment was carried out by immersing the regenerated collagen fibers in an aqueous solution of 25° C. containing 15% by weight of sodium sulfate and 0.5% by weight of formaldehyde (adjusted to pH 9 by using boric acid and sodium hydroxide) for 15 minutes instead of the treatment with epichlorohydrin.

COMPARATIVE EXAMPLE 2

Experiment was carried out in the same manner as in Example 7 except that the treatment with aluminum salt was omitted.

The thus-obtained regenerated collagen fibers were examined with regard to denier, aluminum content, hair iron heat resistance, forming of curl, curling characteristics, generation of foul odor and gas component in the gas phase according to the following method.

(Denier)

Denier was measured in an atmosphere adjusted to temperature of 20±2° C. and relative humidity of 65±2% by using a denier measurement Denier Computer DC-77A (made by Search Co., Ltd.).

(Aluminum Content)

After drying the regenerated collagen fibers in a desiccator, 0.1 g of the fibers were heated and dissolved in a solution obtained by mixing 5 ml of nitric acid and 15 ml of hydrochloric acid. The mixture was cooled and diluted fiftyfold with water to measure the aluminum content in the diluted aqueous solution by using an atomic absorption measurement equipment (Z-5300 type) made by Hitachi, Ltd. The aluminum content measured according to this method means the content of metal aluminum alone. The value was multiplied by 1.89 to calculate the content of aluminum oxide ($Al_2O_3$).

(Hair Iron Heat Resistance)

The following procedures were taken in an atmosphere adjusted to temperature of 20±2° C. and relative humidity of 65±2%.

Fibers were opened sufficiently and put together into a bundle of 22,000 dtex and 250 mm long. A hair iron (Perming Iron made by Hakko Kogyo Co., Ltd.) was pressed lightly to the bundle with adjusting temperature to various values. By a quick slide of the iron both on the top face and the bottom face of the bundle (two seconds/slide), water on the fiber surface was vaporized. The fiber bundle was nipped with the iron, which was slid from the root to the tip in five seconds. After the treatment, shrinkage percentage of the bundle was determined and crimple of the fiber tip was examined. The shrinkage percentage was calculated by using L indicating fiber length before ironing and $L_0$ indicating fiber length after ironing (in case where the bundle is twisted, $L_0$ was measured by extending the twisted bundle) according to the following equation (1):

$$\text{Shrinkage percentage}=[(L-L_0)/L]\times 100 \quad (1)$$

The maximum temperature at which the shrinkage percentage after ironing was at most 5% and crimple of the fibers was not observed was described as the temperature for hair iron heat resistance. The temperatures of the hair iron were set in 10° C. increments. A new fiber bundle without prior ironing was used at every measurement at each temperature.

(Forming of curl and measurement of curling characteristics)

Forming of curl and measurement of curling characteristics were carried out in the following manner.

(1) A fiber bundle opened sufficiently and adjusted to 145,000 dtex (6.5 g/45 cm) was folded into two and tied with string. The bundle was trimmed off in the same fiber length at the point 20 cm from the knot.

(2) The fiber bundle was divided into eight portions. Each portion was wound around an aluminum pipe having a major diameter of 12 mm and both ends of the bundle was fixed to the pipe by rubber bands to prevent the bundle from moving.

(3) The fiber-wound rod was then put into hot water adjusted to 85° C. for 15 minutes to moisturize the fibers.

(4) The rod was taken from hot water and dried in a hot air convection dryer (PV-221 made by Tabai Espec Corporation) for 15 minutes.

(5) Then, the rod was took out from the hot air convection dryer and cooled at room temperature for about 15 minutes to unwind the fiber bundle.

(6) As plain shampoo, the fiber bundle was washed by shaking 20 times in hot water of 40° C. The fiber bundle was taken out from hot water, and water on the surface was first wiped off by a towel and then removed by shaking. The bundle was hung up with keeping the spiral form, and curl length from the knot to the curl tip ($C_p$cm) without load and the length in case of stretching the curl ($C_p$cm) were measured, respectively. The bundle was then dried in the hot air convection dryer adjusted to 50° C.

(7) The dried fiber bundle was shampooed with combing 20 times in hot water adjusted to 40° C., containing 0.2% of shampoo (Super Mild Shampoo/Floral Fruity available from Shiseido Co. Ltd.). Light rinsing was carried out with rubbing under hot running water of 40° C. Water was removed in the same manner as in (6). Thereafter, the bundle was hung up with keeping the spiral form, and curl length from the knot to the curl tip ($C_s$cm) without load and the length in case of stretching the curl ($L_s$cm) were measured, respectively. The bundle was then dried again in the hot air convection dryer adjusted to 50° C.

(8) The procedure in (7) was repeated to evaluate shampoo resistance of the curl (curling percentage against the number of shampoo)

(9) Curling characteristics for evaluation were calculated in accordance with the following equations (2), (3) and (4).

Curling percentage immediately after plain shampoo (Ps)

$$Ps=(20-C_p)\times 100/L_p(\%) \quad (2)$$

Curling percentage immediately after shampoo (Sc)

$$Sc=(20-C_s)\times 100/L_s(\%) \quad (3)$$

Curling retention immediately after shampoo (Ss)

$$Ss=(L_s-C_s)\times 100/(L_s-C_s)(\%) \quad (4)$$

Table 1 and Table 2 show curling percentage after plain shampoo, curling percentage immediately after five shampoos and curling retention immediately after five shampoos as representative values.

(Confirmation of odor)

In consideration of heat treatment for regenerated collagen fibers by dryer or the like, fibers were subjected to thermal treatment for 10 minutes in a hot air convection dryer adjusted to 100° C. Sniffing of the fibers was carried out to confirm whether typical odor of a sulfur-containing compound was generated or not.

(Gas component analysis in gas phase)

The fiber sample thermally treated at 100° C. was placed in a 20 ml vial bottle in an amount of 0.2 g. The sample was re-heated at 60° C. for 10 minutes, and the gas phase was analyzed with measuring amounts of ions detected by gas chromatography mass spectrometer QP-5050 made by Shimadzu Corporation with increasing temperature at a rate of 10° C./minute between 40° to 200° C. and at a rate of 20° C./minute between 200° to 280° C.

TABLE 1

| Ex. No. | Denier (d) | Aluminum oxide content (%) | Curling percentage after plain Shampoo (%) | Curling percentage immediately after five shampoos (%) | Curling retention immediately after five shampoos (%) |
|---|---|---|---|---|---|
| 1 | 67 | 12.5 | 28.2 | 20.5 | 70.0 |
| 2 | 78 | 11.5 | 23.1 | 15.9 | 65.0 |
| 3 | 61 | 10.5 | 28.2 | 19.5 | 66.0 |
| 4 | 75 | 9.5 | 22.6 | 15.4 | 64.1 |
| 5 | 65 | 11.2 | 28.3 | 19.7 | 67.1 |

TABLE 2

| Ex. No. | Denier (dtex) | Aluminum oxide content (%) | Curling percentage after plain shampoo (%) | Curling percentage immediately after five shampoos (%) | Curling retention immediately after five shampoos (%) | Hair iron heat resistance (° C.) | Generation of foul odor |
|---|---|---|---|---|---|---|---|
| 6 | 66 | 8.2 | 28.2 | 19.5 | 66.0 | 140 | generated |
| 7 | 67 | 8.5 | 28.2 | 19.5 | 66.0 | 140 | none |
| 8 | 71 | 11.2 | 28.3 | 19.7 | 67.1 | 160 | none |
| 9 | 83 | 11.5 | 23.1 | 15.9 | 65.0 | — | none |
| 10 | 61 | 4.7 | 23.1 | 15.4 | 62.5 | 130 | none |
| 11 | 72 | 11.7 | 25.6 | 15.4 | 55.6 | 150 | none |
| 12 | 58 | 4.3 | 21.5 | 12.8 | 54.1 | 130 | none |
| 13 | 68 | 8.5 | 28.4 | 19.6 | 65.5 | 140 | none |
| 14 | 66 | 8.4 | 28.3 | 19.5 | 65.7 | 140 | none |
| Com. Ex. 1 | 70 | 13.0 | 23.1 | 5.1 | 12.2 | 160 | none |
| Com. Ex. 2 | 54 | 0 | 12.5 | 7.5 | 50.0 | 120 | none |

denier: 1 dtex (decitex) = 0.9 d (denier)

The results in Table 1 and Table 2 show that it is possible to obtain fibers which has light color and excellent wet touch by treating regenerated collagen fibers with a monofunctional epoxy compound and aluminum salt. The results also show that it is possible to obtain fibers which can be formed into desirable shapes by keeping fibers at temperature of 20° to 100° C. in the presence of water and then drying fibers at temperature of 60° to 220° C. In addition, it was also possible to obtain fibers which did not give off foul odor typical to a sulfur-containing compound even at heating by treating collagen with an oxidant before the treatment with the monofunctional epoxy compound.

Figure 2:
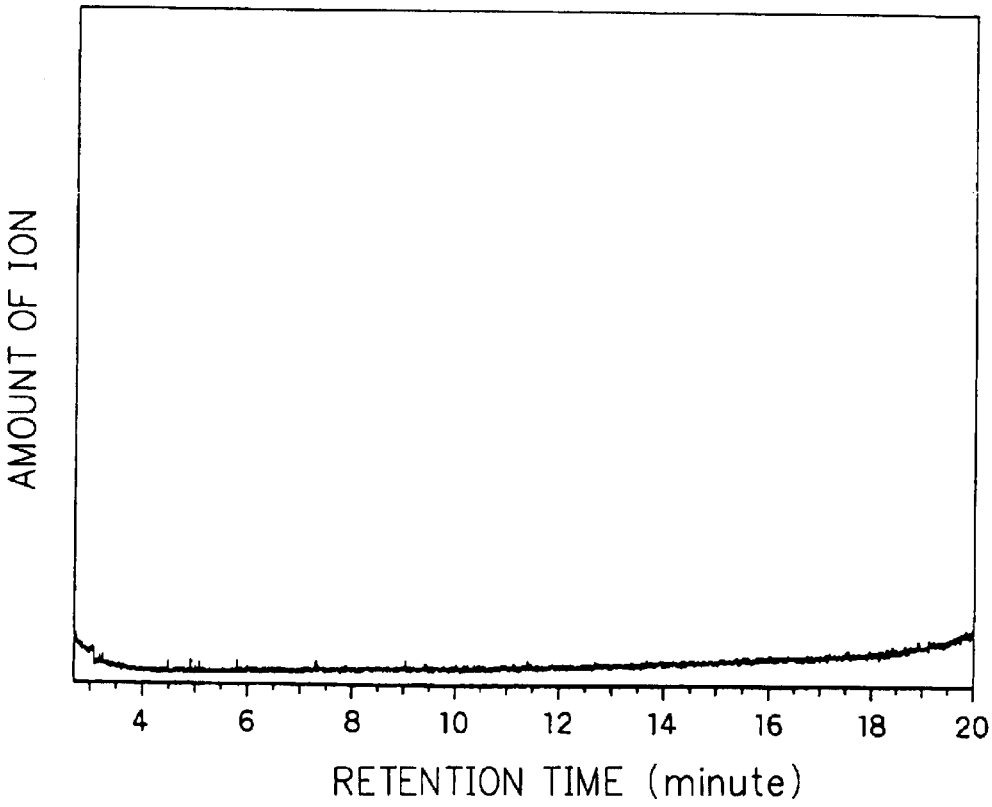
FIG. 2 is a chart obtained by measurement of gas generated from regenerated collagen fibers prepared in Example 7 by using a gas chromatograph mass spectrometer.

The results of the gas component analysis are shown in FIG. 1 and FIG. 2.

FIG. 1 shows the results of analysis of gas generated from the fibers prepared in Example 6. Four peaks were detected in this measurement. It was revealed that peak 1 represented methyl mercaptan, peak 2 dimethyl sulfide, peak 3 dimethyl disulfide and peak 43-(methylthio)-propion aldehyde as a result of analysis of the four peaks by mass spectrography.

FIG. 2 shows the results of analysis of gas generated from the fibers prepared in Example 7. No peak was observed in this measurement.

These results show that generation of foul odor typical to a sulfur-containing compound can be inhibited in case of using regenerated collagen fibers obtained by reacting a monofunctional epoxy compound with collagen after treatment with an oxidant.

INDUSTRIAL APPLICABILITY

The regenerated collagen fibers of the present invention have light color and excellent wet touch. In addition, generation of foul odor typical to a sulfur-containing compound at thermal treatment can be inhibited by reacting a monofunctional epoxy compound with collagen after treating methionine group in collagen with an oxidant.

At the same time, the regenerated collagen fibers of the present invention can be formed into desirable shapes easily with the shape being maintained properly, and suitably used for curling hair ornaments such as wigs, hairpieces and doll hair or for shaping (setting) textile goods comprising woven fabrics or non-woven fabrics.

What is claimed is:

1. A regenerated collagen fiber which is obtained by treating collagen with a monofunctional epoxy compound and an aluminum salt.

2. The regenerated collagen fiber of claim 1, wherein said monofunctional epoxy compound is a compound represented by the following formula (I):

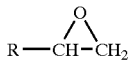

(I)

in which R indicates a substituent group represented by $R_1$—, $R_2$—O—$CH_2$— or $R_2$—COO—$CH_2$—, $R_1$ in said substituent group indicates a hydrocarbon group having at least 2 carbon atoms or $CH_2Cl$ and $R_2$ indicates a hydrocarbon group having at least 4 carbon atoms.

3. The regenerated collagen fiber of claim 2, wherein said $R_1$ in the formula (I) indicates a hydrocarbon group having 2 to 6 carbon atoms or —$CH_2Cl$ and $R_2$ indicates a hydrocarbon group having 4 to 6 carbon atoms.

4. The regenerated collagen fiber of claim 1, 2 or 3, wherein said collagen has a sulfoxidized methionine group or a sulfonated methionine group.

5. A process for preparing the regenerated collagen fiber of claim 1 comprising the steps of treating said collagen with a monofunctional epoxy compound, and then treating said collagen in such a way that 2 to 40% by weight of an aluminum salt converted to an aluminum oxide basis is contained to said collage.

6. The process for preparing a regenerated collagen fiber of claim 5, comprising the additional step of treating said collagen with an oxidant and then treating said collagen with the monofunctional epoxy compound and the aluminum salt.

7. The process for preparing a regenerated collagen fiber of claim 6, wherein said oxidant is hydrogen peroxide.

8. A process for setting a regenerated collagen fiber comprising the steps of thermally setting the regenerated collagen fiber of claim 1, 2 or 3 by means of hot water treatment at 20° to 100° C. and a heat drying treatment at 60° to 220° C.

* * * * *